United States Patent [19]

Lorber

[11] Patent Number: 4,914,791

[45] Date of Patent: Apr. 10, 1990

[54] PLASTIC PAPER CLIP

[76] Inventor: Kurt Lorber, Schurwaldstrasse 114, D-7307 Aichwald 2, Fed. Rep. of Germany

[21] Appl. No.: 344,495

[22] Filed: Apr. 26, 1989

Related U.S. Application Data

[63] Continuation of Ser. No. 127,450, Dec. 2, 1987, abandoned.

[30] Foreign Application Priority Data

Jan. 8, 1987 [DE] Fed. Rep. of Germany ..... 3700322

[51] Int. Cl.[4] ..... A44B 21/00

[52] U.S. Cl. ..... 24/67.9; 24/563

[58] Field of Search ..... 24/67.9, 67.3, 67 R, 24/545, 546, 547, 561, 555, 556, 563, DIG. 8

[56] References Cited

U.S. PATENT DOCUMENTS 3,673,641 7/1972 Lorber ..... 24/67.9

FOREIGN PATENT DOCUMENTS

| | | | |
|---|---|---|---|
| 457163 | 3/1928 | Fed. Rep. of Germany | 24/547 |
| 203466 | 11/1958 | Fed. Rep. of Germany | 24/67.9 |
| 1166149 | 3/1964 | Fed. Rep. of Germany . | |
| 1536639 | 1/1970 | Fed. Rep. of Germany | 24/561 |
| 2037708 | 5/1972 | Fed. Rep. of Germany . | |
| 1195870 | 11/1959 | France | 24/67.9 |
| 1489764 | 7/1967 | France | 24/67.9 |
| 357374 | 11/1961 | Switzerland | 24/67.9 |

*Primary Examiner*—Laurie K. Cranmer

*Attorney, Agent, or Firm*—Steele, Gould & Fried

[57] ABSTRACT

A plastic paper clip having two outer, approximately V-shaped clamping legs connected by transverse webs to a pair of clamping arms disposed within the clamping legs, has a longitudinal slot terminating at an extension element leading to the clamping arms. The extension element is not slotted. When applied to clip paper, the clip is subjected to torque in the area of the longitudinal slot, but the extension element keeps the torque from deforming the clamping arms.

7 Claims, 1 Drawing Sheet

PLASTIC PAPER CLIP

CROSS REFERENCE TO RELATED APPLICATION

This is a continuation of application Ser. No. 127,450, filed Dec. 2, 1987, now abandoned.

BACKGROUND OF THE INVENTION

The invention relates to a plastic paper clip with two outer, approximately V-shaped, spread-apart clamping legs, which are connected by means of transverse webs to two parallel clamping portions separated by a slot, on whose ends is arranged a connecting plate, which has two, also V-shaped, spread-apart clamping arms.

A plastic paper clip of this type is already known (German patent 20 37 708, corresponding to U.S. Pat. No. 3,673,641), in which the principal problem addressed was to provide such a clip which can be used for very thick stacks of paper. In the case of this clip, the longitudinal slot extends over somewhat more than half of the length of the clip and extends substantially up to the connecting point between the connecting plate and the inner clamping arms. Consequently there is a risk that on applying the paper clip to stacks of paper the torsion of the parallel clamping portions, which bring about the clamping action, will also lead to a deformation of the clamping arms, which is not desired.

In addition, a plastic paper clip is known (German patent 11 66 149), in which the outer and inner clamping legs are both splayed in V-shaped manner and are interconnected in the vicinity of their ends.

SUMMARY OF THE INVENTION

The object of the present invention is to provide a paper clip and in particular a paper clip of the aforementioned type, which can be economically produced by injection moulding and in which a high clamping force is obtained, even when the paper stack is not very thick.

According to the invention this object is achieved in that in the case of a paper clip, the longitudinal slot extends at most over approximately one third of the length of the clip, the clamping portions are connected by means of an extension portion to the connecting plate and the gap between the extension element and the clamping arms is constructed as a slot with an at least partly sloping longitudinal direction. In order that paper clips can correctly fulfil their function, it is often the case that the inner portion extends over roughly $\frac{2}{3}$ to $\frac{3}{4}$ of the length of the complete paper clip. Shortening of the slot leads to no change in the length of the inner clamping portion, but the clamping force which can be obtained is greater. The clamping force is largely obtained through the torsion of the two longitudinally directed clamping portions. The shortening of the longitudinal slot leads to a shortening of the torsionally stressed clamping portions and consequently to an increase in the clamping force. Through the construction of the lateral gaps as longitudinal slots the bending of the inner clamping portion caused by the torsion is kept away from the clamping arms, so that they can fulfil their function of offering a large-area engagement on the paper sheets. Due to the fact that the longitudinal slots at least in part slope, it is possible to use the clip form even in the case of very small paper clips.

According to a further development the lateral slots have substantially parallel side edges and have the same width throughout.

According to a further development the clamping arms also have parallel side edges. In the case of the aforementioned, known paper clips, the clamping arms had a slightly convergent shape with decreasing thickness.

According to the invention the clamping arms can be parallel to the outer clamping legs.

BRIEF DESCRIPTION OF THE DRAWINGS

Further features, details and advantages of the invention can be gathered from the following description of a preferred embodiment relative to the drawings, wherein.

DETAILED DESCRIPTION OF THE PREFERRED EMBODIMENTS

Figure 1:
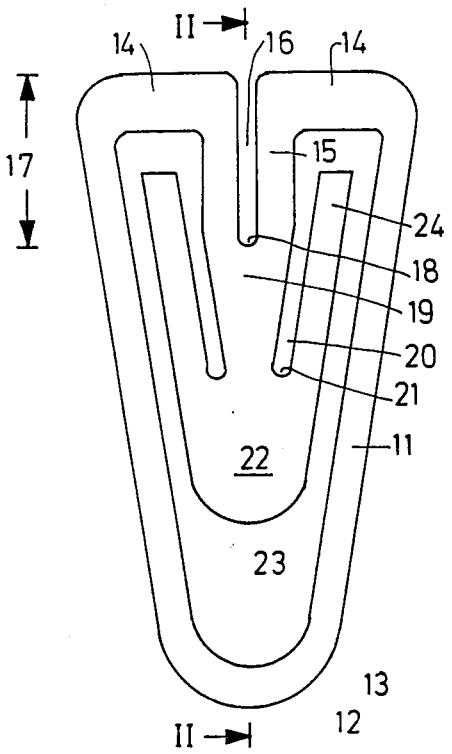
FIG. 1 is plan view of a paper clip proposed by the invention.

The paper clip for clipping together at least two sheets of paper shown in FIG. 1 contains two outer clamping legs 11, which are approximately V-shaped splayed. In the vicinity of the pointed end 12 of the paper clip, the clamping legs 11 are interconnected by a rounded bend 13. In the vicinity of their facing ends, where they are splayed to the greatest extent, each of the outer clamping legs 11 passes into a transverse web 14, which is perpendicular to the longitudinal direction of the paper clip. The longitudinal direction of the paper clip is the angle bisector between the two linear, outer clamping legs 11, said angle bisector also forming a symmetry line for the paper clip. On their facing inner ends, the transverse webs 14 in each case pass into a clamping portion 15. These clamping portions 15 are once again at right angles to the transverse webs and pass into the interior of the clip, i.e. within the outer clamping leg 11. The clamping portions 15 are parallel to one another and to the line of symmetry of the paper clip. They are separated from one another by a longitudinal slot 16, which in the represented embodiment has the same width throughout. The longitudinal slot 16 has a length 17, which is approximately 30% of the total length of the paper clip. On clipping together two sheets of paper, the longitudinal slot 16 makes it possible to turn the two transverse webs out of the paper plane, which leads to a torsion of the clamping portion 15. On their ends corresponding to end 18 of slot 16, the clamping portions 15 pass into a slightly converging extension element 19, which is bounded on either side by sloping slots 20. At the lower end 21 of slots 20 in FIG. 1, extension element 19 passes into a connecting plate 22, whose lower end 23 is arcuately rounded. The distance from the upper edge of the clip to the lower end 23 of connecting plate 22 approximately corresponds to $\frac{2}{3}$ to $\frac{3}{4}$ of the total length of the paper clip.

On either side of the connecting plate are shaped clamping arms 24, which have the same width throughout and extend into the space between the extension element 19 or the clamping portions 15 and the outer clamping legs 11. They are parallel to the outer clamping legs 11 and between their outer edges and said legs 11 is formed a gap which is of the same width throughout.

As a result of the arrangement of the extension element 19 between clamping portions 15 and connecting plate 22, it is ensured that a deformation brought about by the torsion of clamping portions 15 does not extend to the connecting plate 22 and the clamping arms 24. Simultaneously, through the relatively short longitudinal slot 16 and the consequently short clamping portions 15, it is ensured that the clamping force is adequate to ensure that the paper clip, in the most frequently encountered case, namely the clipping together of two sheets of paper, has an adequate retaining effect.

Figure 2:
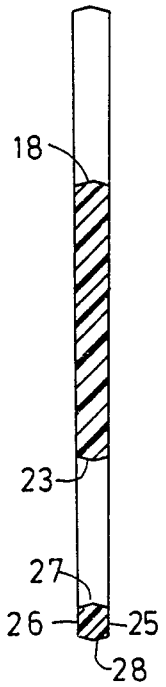
FIG. 2 is section along line II—II of FIG. 1.

It can be seen from the section of FIG. 2 that the profile of the clip has a planar top 25 and a planar bottom 26. The side walls 27 or 28 of the profile are slightly convergent, the angle to be seen in FIG. 2 being approximately 150°. A cross-section through the other parts of the paper clip is formed in the same way.

I claim:

1. A plastic paper clip, comprising:

two outer clamping legs, splayed at an angle of approximate 15 to 20 degrees to define an approximate V-shape having a longitudinal axis, the outer clamping legs having constant width and thickness along their entire length;

a pair of transverse webs, each connected to one of the clamping legs and leading inwardly toward the longitudinal axis;

two parallel clamping portions separated by a slot, the parallel clamping portions being attached to the transverse webs;

a connecting plate and two V-shaped splayed clamping arms, the clamping arms having constant width and thickness along their entire length, defining parallel side edges of the clamping arms and being attached to the connecting plate such that the clamping arms are parallel to the clamping legs, the slot separating the clamping portions at most extending over approximately one third of a length of the clip, the clamping portions being connected to the connecting plate by an extension element clear of the longitudinal slot, the extension element having a length approximately equal to a length of the slot separating the clamping portions, and a gap being defined between the extension element and the clamping arms in the form of a slot with substantially parallel side edges, sloping at least partly relative to the longitudinal axis of the clip.

2. A plastic paper clip, comprising:

two outer clamping legs, splayed at an angle of approximately 15 and 20 degrees to define an approximate V-shape, the outer clamping legs having constant width and thickness along their entire length;

a pair of transverse webs and two parallel clamping portions attached to the transverse webs and separated by a slot extending at most over approximately one third of an overall length of the clip;

an extension element, connected to the clamping portions clear of the slot, the extension element having a length approximately equal to a length of the slot;

a connecting plate, attached to the extension element, the connecting plate having two V-shaped splayed clamping arms with parallel side edges and with a constant width and thickness along their entire length, a gap being defined between the extension element and the clamping arms, the gap forming a slot with substantially parallel side edges sloping relative to a longitudinal direction of the clip.

3. The paper clip according to claims 1 or 2, wherein the extension element has a convergent construction in an area between the clamping portions and the connecting plate.

4. The paper clip according to claims 1 or 2, wherein the clamping arms define a splaying angle of between approximately 15 and approximately 20°.

5. The paper clip according to claims 1 or 2, wherein the extension element converges on its sides at an angle between approximately 15 and approximately 20°.

6. An improved paper clip of the type having a pair of outer clamping legs connected in a V-shape and a pair of inner clamping arms connected in a V-shape, the clamping legs being connected to the clamping arms along transverse webs and clamping portions extending inwardly from a top of the V-shape clamping legs and downwardly to a point between the V-shape clamping arms, a longitudinal slot being defined between the clamping portions, said clamping portions being twisted when the clamping arms and clamping legs are separated from one another by an article to be clipped, the improvement comprising:

an extension element disposed between the clamping portions and the clamping arms, the extension element being clear of the longitudinal slot and having a length approximately equal to a length of the longitudinal slot, gaps being defined between the clamping arms and the clamping legs, the clamping arms and clamping legs each having constant width and thickness along their respective lengths, said gaps having parallel side edges and being parallel to one another, the gaps on each side of the clip defining a splaying angle of approximately 15 to 20 degrees.

7. The improved clip of claim 6, wherein said longitudinal slot extends at most over approximately one third of a length of the clip.

* * * * *

UNITED STATES PATENT AND TRADEMARK OFFICE

CERTIFICATE OF CORRECTION

PATENT NO. : 4,914,791

DATED : April 10, 1990

INVENTOR(S) : Lorber

It is certified that error appears in the above-identified patent and that said Letters Patent is hereby corrected as shown below:

Column 4, line 41, after "defined" insert --between the clamping portions and the clamping arms, and--.

Signed and Sealed this

Seventh Day of January, 1992

*Attest:*

HARRY F. MANBECK, JR.

*Attesting Officer*

*Commissioner of Patents and Trademarks*